US005935010A

United States Patent [19]

Clarke

[11] Patent Number: 5,935,010

[45] Date of Patent: Aug. 10, 1999

[54] CAROUSEL DEVICE

[76] Inventor: William A. Clarke, 4549 Budd Dr., Erie, Pa. 16506

[21] Appl. No.: 08/918,536

[22] Filed: Aug. 22, 1997

Related U.S. Application Data

[60] Division of application No. 08/575,494, Dec. 20, 1995, Pat. No. 5,660,430, which is a continuation-in-part of application No. 08/126,040, Sep. 23, 1993, Pat. No. 5,487,705.

[51] Int. Cl.[6] ..... A63G 1/10

[52] U.S. Cl. ..... 472/29; 297/256.12; 297/344.21

[58] Field of Search ..... 472/4, 28, 29, 472/96, 97; 297/130, 133, 260.1, 260.2, 266.1, 267.1, 344.21, 344.23, 256.12, 256.13, 256.16

[56] References Cited

U.S. PATENT DOCUMENTS

| | | | |
|---|---|---|---|
| 4,379,588 | 4/1983 | Speice | 297/217 |
| 4,862,530 | 9/1989 | Chen | 5/66 |
| 4,911,499 | 3/1990 | Meeker | 297/260 |
| 4,936,629 | 6/1990 | Young | 297/250 |
| 4,969,685 | 11/1990 | Chihaya et al. | 297/349 |
| 4,971,392 | 11/1990 | Young | 297/250 |
| 5,183,312 | 2/1993 | Nania | 297/250 |
| 5,314,365 | 5/1994 | Chen | 446/133 |

*Primary Examiner*—Kien T. Nguyen
*Attorney, Agent, or Firm*—Richard K Thomson

[57] ABSTRACT

A toddler carousel is formed by providing a rotational base member with a mountable seat such as a pony. Preferably, the seat is mounted in the center of the carousel and can be rocked by the toddler. The rotational base is rotated relative to a stationary base by a motor and, by virtue of bearings positioned between the rotational and stationary bases. Alternatively, the seat may be mounted adjacent the periphery of the carousel to provide the toddler with a more conventional carousel-type ride.

6 Claims, 7 Drawing Sheets

CAROUSEL DEVICE

FIELD OF THE INVENTION

The present invention is directed to a carousel for entertaining an infant or toddler by rotating them, with or without an additional rocking motion. More particularly, the present invention is directed to a carousel pony and forms a divisional application of U.S. patent application Ser. No. 08/575,494, filed Dec. 20, 1995, which issued as U.S. Pat. No. 5,660,430 issued Aug. 26, 1997 which is a CIP of U.S. patent application Ser. No. 08/126,040, filed Sep. 23, 1993, which issued Jan. 30, 1996 as U.S. Pat. No. 5,487,705.

BACKGROUND AND SUMMARY OF THE INVENTION

Entertaining an infant is easy at a large family gathering. The baby can simply be passed from one pair of waiting arms to the next. However, when mom is home alone with the baby or at a smaller get-together, what to do with the baby when he or she is awake can become a problem. When left in a car seat, bassinet, playpen or the like, the baby quickly becomes bored and cranky. While a swing or jumper seat may provide some entertainment for toddlers, these devices are frequently inappropriate for infants and provide only a respite of limited duration from the inevitable boredom associated with looking at the same thing.

The invention of the parent application is directed to an entertainment device for infants comprising a stationary base, a seat which receives the baby in a semi-reclined position, a motor for rotating the seat relative to the base and a source of power for the motor. Preferably, the infant carousel is equipped with a programmed microchip, a music box, or the like, which plays a lullaby or other soothing music which will induce sleep. The power source may be an a.c. source but is preferably a d.c. battery or mechanical spring in order to eliminate the need for a cord and plug.

This infant carousel rotates the baby through 360°, preferably at a rate of between one-half and four revolutions every minute, allowing her/him to see everyone and everything in the room. Further, everyone in the room gets a good view of the baby. This is unlike a conventional swing which gives the baby and the onlookers the same view all the time. The preferred embodiment of the parent invention employs a one-piece molded plastic seat member which is contoured to receive the child. The seat member is preferably equipped with a seat belt to prevent the child from falling or crawling out of the device.

A perceived problem with this earlier device is that, while it is relatively light weight, weighing less than 30 pounds, it is somewhat bulky and difficult for most mothers to move from room to room, particularly with the child in it. The present invention addresses this perceived problem with a redesigned molded upper member which becomes a receptacle for a baby carrier. When the baby needs changing or when mom no longer wishes to have the baby in the carousel, she simply grasps the handle of the carrier and lifts it and the baby out of the molded receptacle. The baby carrier may be specifically designed for use with the carousel or, more preferably, is a multiple use carrier that is used with other devices such as a car seat, a stroller or simply as a pumpkin seat.

As an optional feature, the base may be formed with a cam track upon which the roller of an actuator rod rides. The other end of the actuator rod engages in an opening formed on the back of the baby carrier and gently rocks the carrier as the carousel rotates. A second embodiment of the new upper member allows much less plastic to be used, significantly reduces the mold cost and cycle times resulting in more competitive costs per piece.

It is an additional feature of the present invention that the same base can be utilized to support a toddler carousel having a rideable character such as a pony, or the like. In a first embodiment, the pony has rockers on its feet and is mounted directly in the center of the carousel and simply rotates about its vertical axis. The toddler can rock the pony as the base rotates the pony and its rider. In a second embodiment of the toddler carousel, the pony or similar sittable character is mounted on the periphery of the carousel and the toddler can experience a more conventional carousel-type ride. The motor for the toddler carousel can be designed to provide a rotational speed of between one and eight rpm and, it is within the scope of the present invention for the gearing to be designed to allow the same motor to provide power for both the infant and toddler carousels.

Various other features, advantages and characteristics of the present invention will become apparent after a reading of the following specification.

DETAILED DESCRIPTION OF THE PREFERRED EMBODIMENTS

Figure 1:
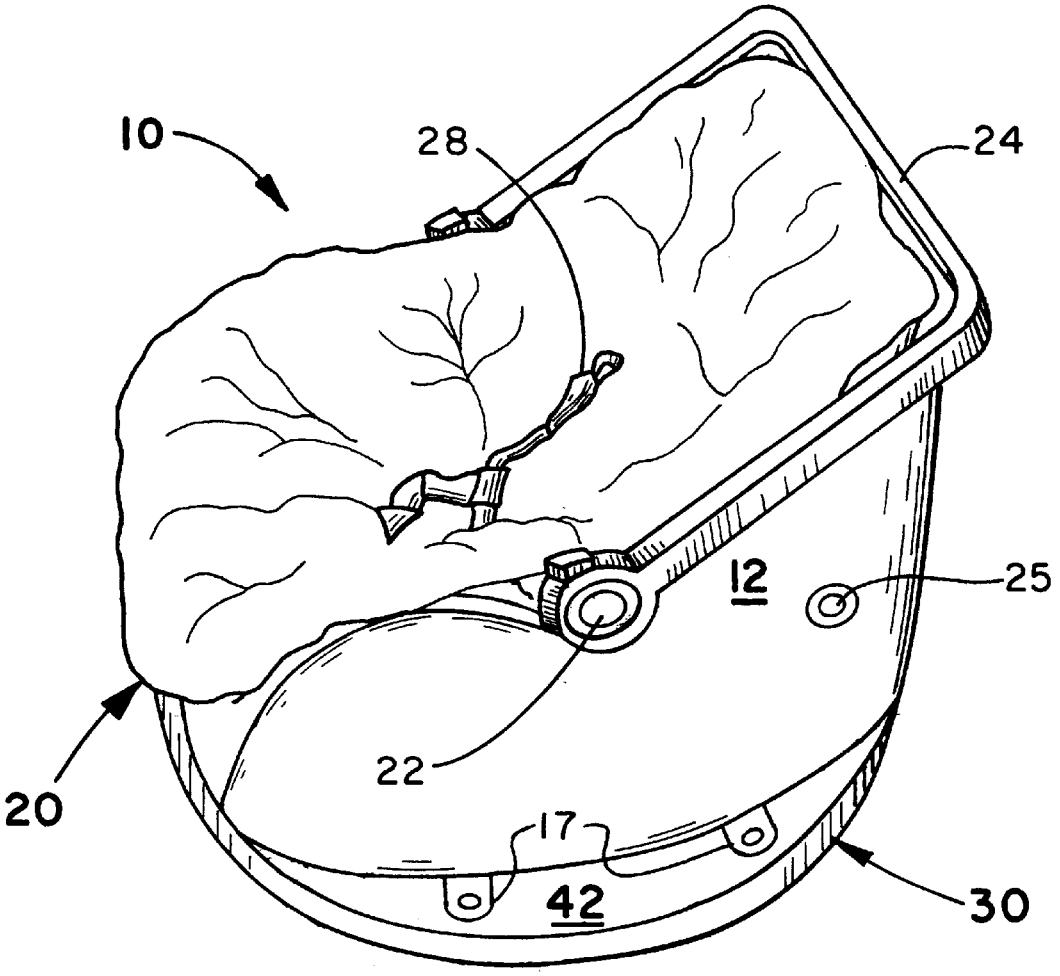
FIG. 1 is a perspective view of the infant carousel of the present invention.
Figure 1A:
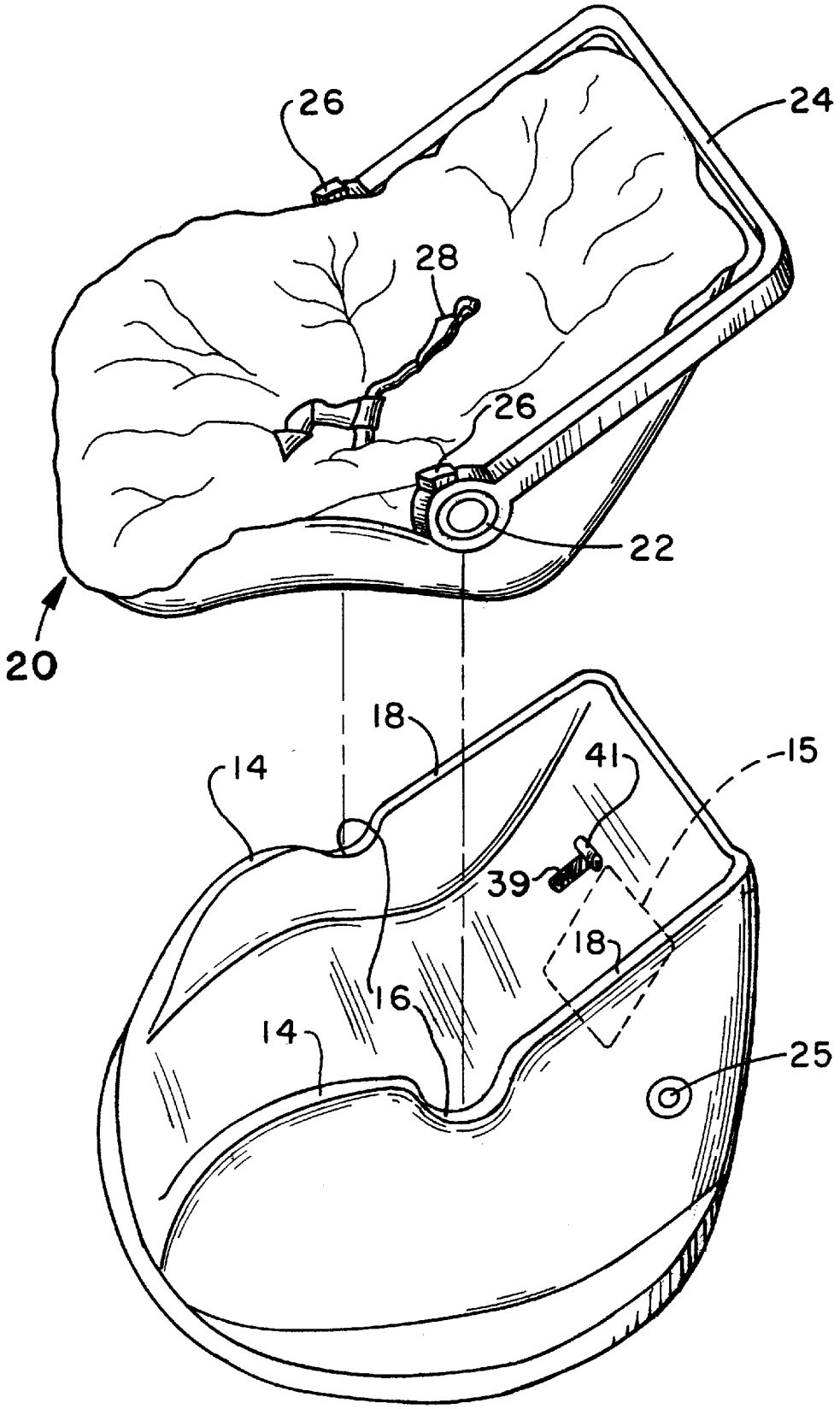
FIG. 1A is an exploded perspective view of the infant carousel shown in FIG. 1.

The infant carousel of the present invention is depicted in FIG. 1 generally at 10. Carousel 10 includes separable seat member 20 which is received in a molded plastic receptacle 12. While molded plastic receptacle 12 may be vacuum formed, it is most preferably made as an injection molded part. Receptacle 12 is seated upon and attached to a base member 30. Separable seat 20 may be made specifically for use with carousel 10 or, more preferably, may comprise an infant carrier or "pumpkin seat" of general utility. Receptacle 12 has a rounded notch 16 (FIG. 1A) formed on each side between sloping surfaces 14 and 18 which receives pivot post 22 of seat member 20 about which carrier arm 24 rotates when detent locking buttons 26 are depressed. Snaps 17 on rotational base 42 can engage posts 19 on receptacle 12 (or visa versa) to maintain these elements together. Obviously, other forms of fasteners such as brads or pop rivets could be used for fastening.

Separable seat member 20 is preferably equipped with a safety strap 28 to keep the baby in the carrier. Typically, an infant under six months of age will not exceed thirty pounds, which is well within the capabilities of the device 10 to support. Molded receptacle 12 has a removable back panel 15 which provides access to the electrical components for servicing as discussed further below. Switch 25 provides the capacity to control the operation of the device as will also be discussed later.

Figure 3B:
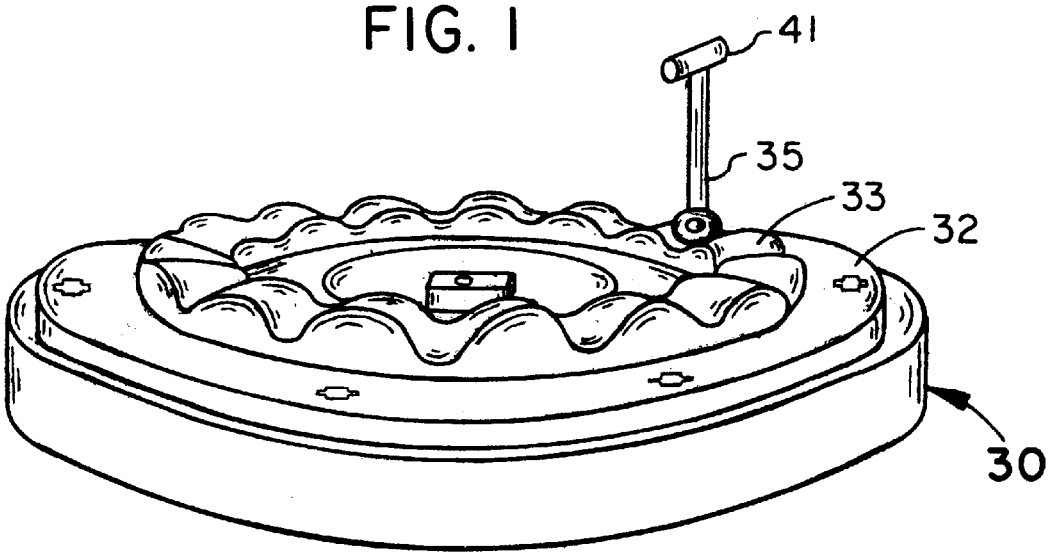
FIG. 3B is a lateral perspective view of alternative embodiment of the stationary base.
Figure 2:
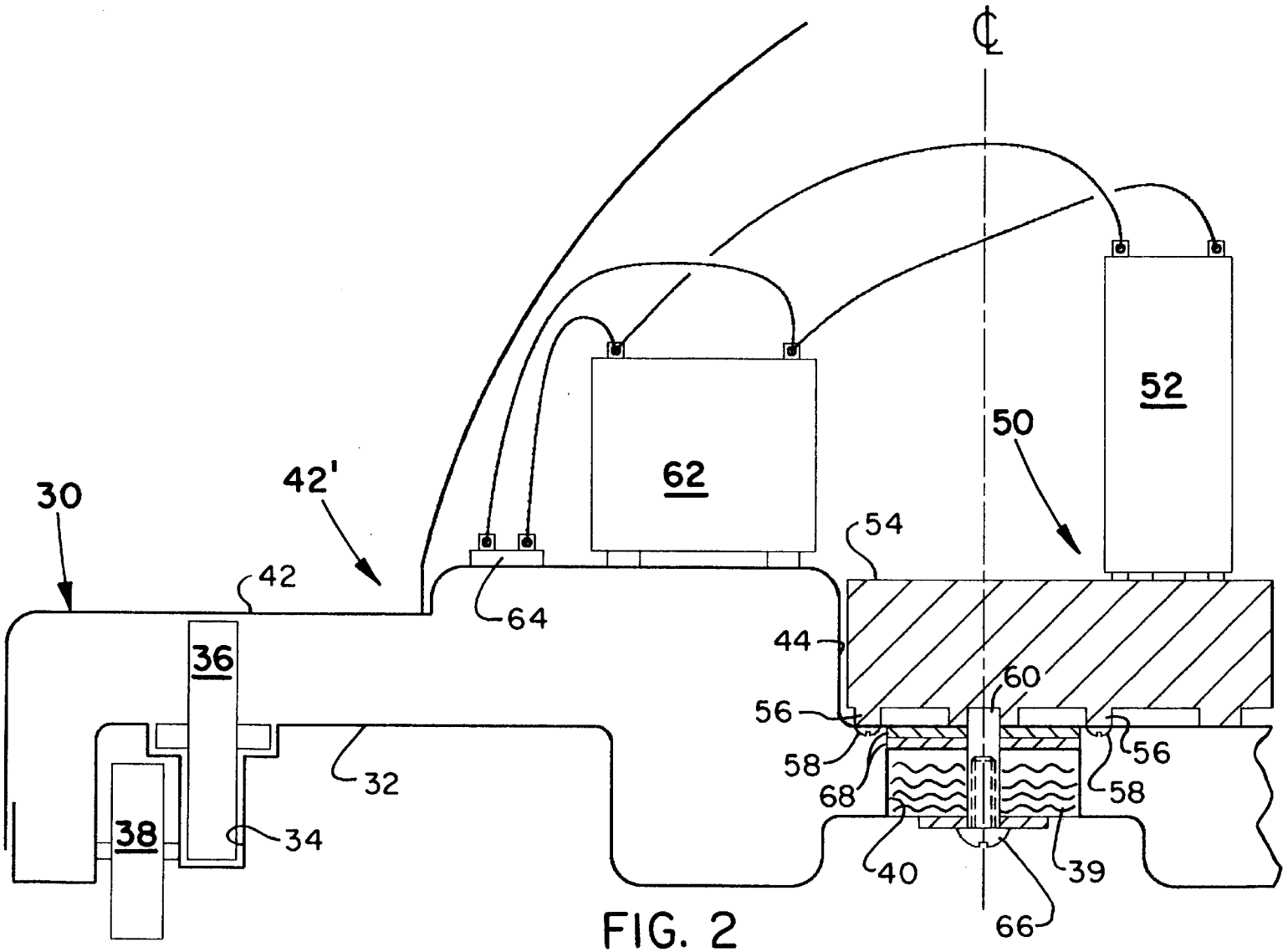
FIG. 2 is a schematic side view with portions broken away to depict the positions of the inner elements.
Figure 4:
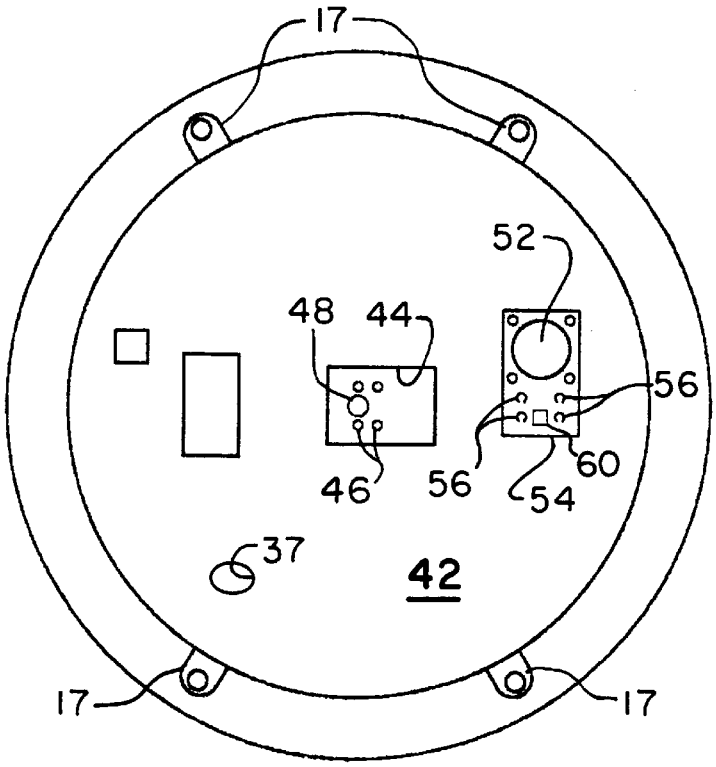
FIG. 4 is a top view of the rotational base with the drive element displaced from the molded receptacle.
Figure 3A:
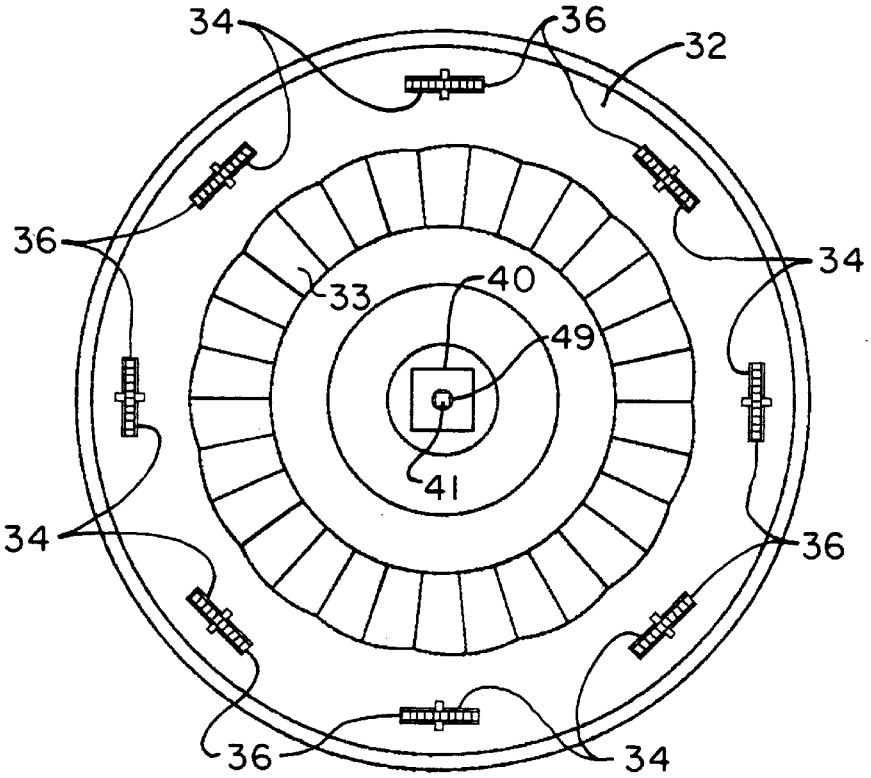
FIG. 3A is a top view of the stationary base.
Figure 5A:
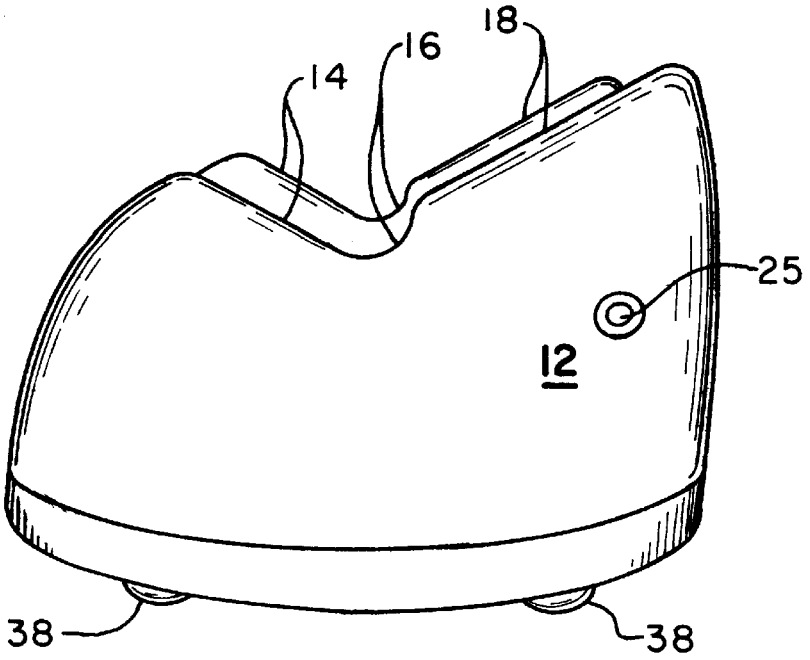
FIG. 5A is a side view of the infant carousel of the present invention.
Figure 5B:
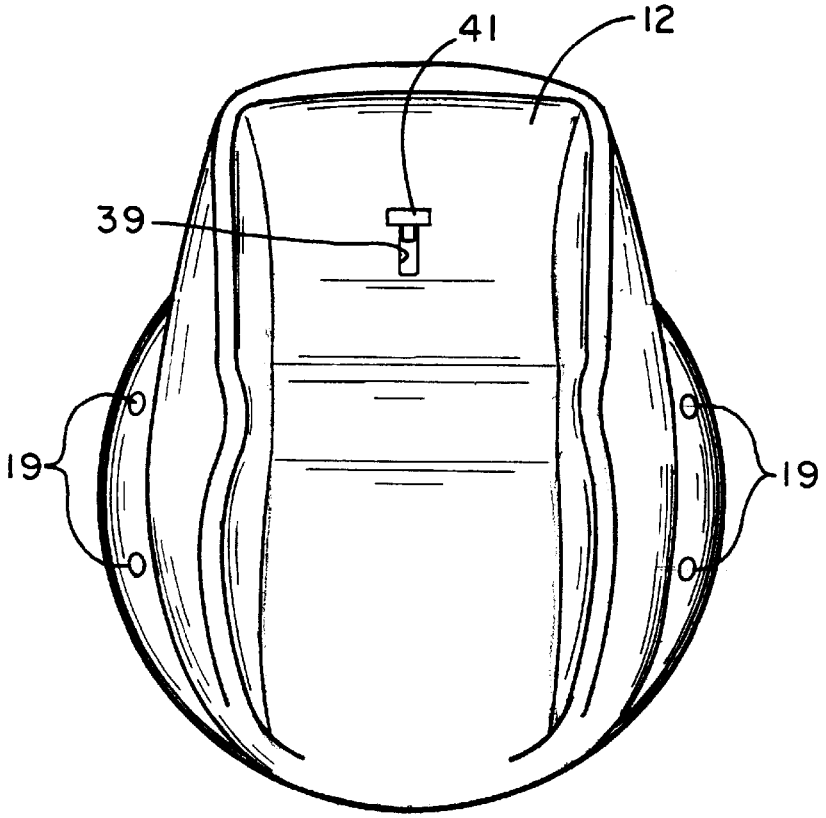
FIG. 5B is a top view of the infant carousel of the present invention.

As can be seen more clearly in FIGS. 2–4, base member 30 includes a stationary base 32 and a rotational base 42. Stationary base 32 has a plurality (eight shown) of recesses 34 which are molded directly into stationary base to receive support rollers 36. Rollers or wheels 36 are preferably made of a self-lubricating material such as TEFLON polymer or a filled nylon, although other materials, such as aluminum, can be used. Stationary base 32 may be provided with casters 38 mounted on its lower surface to permit the carousel 10 to be moved more easily from place to place. A square pillow block 39 is received in a square recess 40 molded into the underneath portion of base 32. Pillow block 39 is of a size to be press fit into recess 40. Alternatively, pillow block 39 maybe integrally molded into recess 40. Block 39 has a non-round opening 41, shown in FIG. 3A as square.

Optionally, stationary base 32 may have a cam track 33 fitted on its top surface. A cam follower rod 35 extends through an opening 37 in rotational base 42 and a slot 39 (FIG. 1A) in receptacle 12 and has a laterally extending portion 41 which is received in a pocket (not shown) in the rear of carrier seat 20. As rotational base 42 turns relative to stationary base 32, cam follower rod 35 will be oscillated up and down by cam track 33 causing the removable seat 20 to be rocked relative to receptacle 12. Should the owner find this rocking to be an undesirable feature, follower rod 35 can simply be removed from the assembly 10 without any effect on the other operation of the carousel.

As best seen in FIG. 2, rotational base 42 sits atop support rollers 36 which serve as bearing means. It will be appreciated that other bearing means (e.g., ball bearings, roller bearings, etc.) could be used to permit relative rotation between stationary base 32 and rotational base 42. As seen in FIG. 2, rotational base 42 is slightly larger than stationary base 32. Rotational base 42 has a recess 44 molded therein for receiving drive element 50. Drive element 50 includes motor 52 and a gear box 54.

Motor 52 can be any off-the-shelf commercially available motor capable of between 800 and 1000 rpm in the no load condition and capable of producing 30 in-lb of torque. Gear box 54 should be able to reduce the rpm to one revolution per minute (i.e., have a reduction ratio on the order of about 1000 to 1). While any commercially available gear reduction box meeting these criteria could be used, one such reducer is available from Rex as gear motor model CXCR1, spec. no. 2994. Alternatively, a conventional mechanical spring drive of the type used to rotate music box elements can be used to provide rotation. However, the battery operated configuration depicted here is preferred for convenience.

Four posts 56 project from gear box 54 and are received through openings 46 in rotational base 42 and secured thereto by fasteners 58. Non-round drive shaft 60, square in this embodiment, extends from gear box 54 through opening 48 in rotational base 42, round opening 49 of stationary base 32 and is received in similarly shaped opening 41 in block 38. Power source 62 which is connected to motor 52 is preferably a 6 volt d.c. battery, although with a different choice of motor, alternating current from a standard wall socket could be used. However, battery source 62 is preferred in order to make carousel 10 more versatile and to eliminate the risk to parents and siblings of cords to trip over. Most preferably, battery source 62 may be four D size batteries which may easily be changed by the operator. A microchip 64 provides music, at the option of the operator, which may, for example, play Brahm's Lullaby. Alternatively, music could be provided by a conventional pin-drum music box.

Switch 25 maybe provided with a rheostat to permit the rate of rotation to be varied over a range from about ½ to about 4 rpm. In addition, switch 25 will provide the operator the capability to shut off the music if mom's jangled nerves prefer the sound of silence. A pair of washers 68 are positioned between stationary base 32 and rotational base 42 to further facilitate relative rotation therebetween. A bolt 66 is threaded into the end of square drive shaft 60 to complete the assembly of stationary base 32 to rotational base 42 which has receptacle 12 secured thereto.

When switch 25 is turned to the 'on' position, motor 52, through gear box 54, will try to rotate shaft 60 and attached stationary base 32 in a first rotational direction. However, since the resistance to movement of the stationary base will generally be greater than the resistance to movement of the rotational base 42 on support rollers 36, motor 52 will rotate the rotational base assembly 42' (together with the motor and gear box) in an opposite rotational direction. Microchip 64 will provide music if the operator rotates switch 25 to a position to select music. Alternatively, a separate switch (not shown) can be provided to control the music.

Motor 52 could be positioned between stationary base 32 and rotational base 42 with drive shaft 60 extending upwardly in order to rotate base 42 in a more conventional manner. However, such a modification would be at a significant cost to the low profile afforded by the preferred design. With the drive element 50 positioned within recess 44 the top of base member 30 is no higher than three inches above the surface upon which it is positioned and the top of the seat 20 is not more than sixteen inches high. Since the base has a diameter of about twenty-six inches, and in any event, not generally exceeding about three feet, carousel 10 is extremely stable and is virtually impossible to tip over, providing a safe, reliable amusement device for infants up to about thirty pounds in size.

Figure 6A:
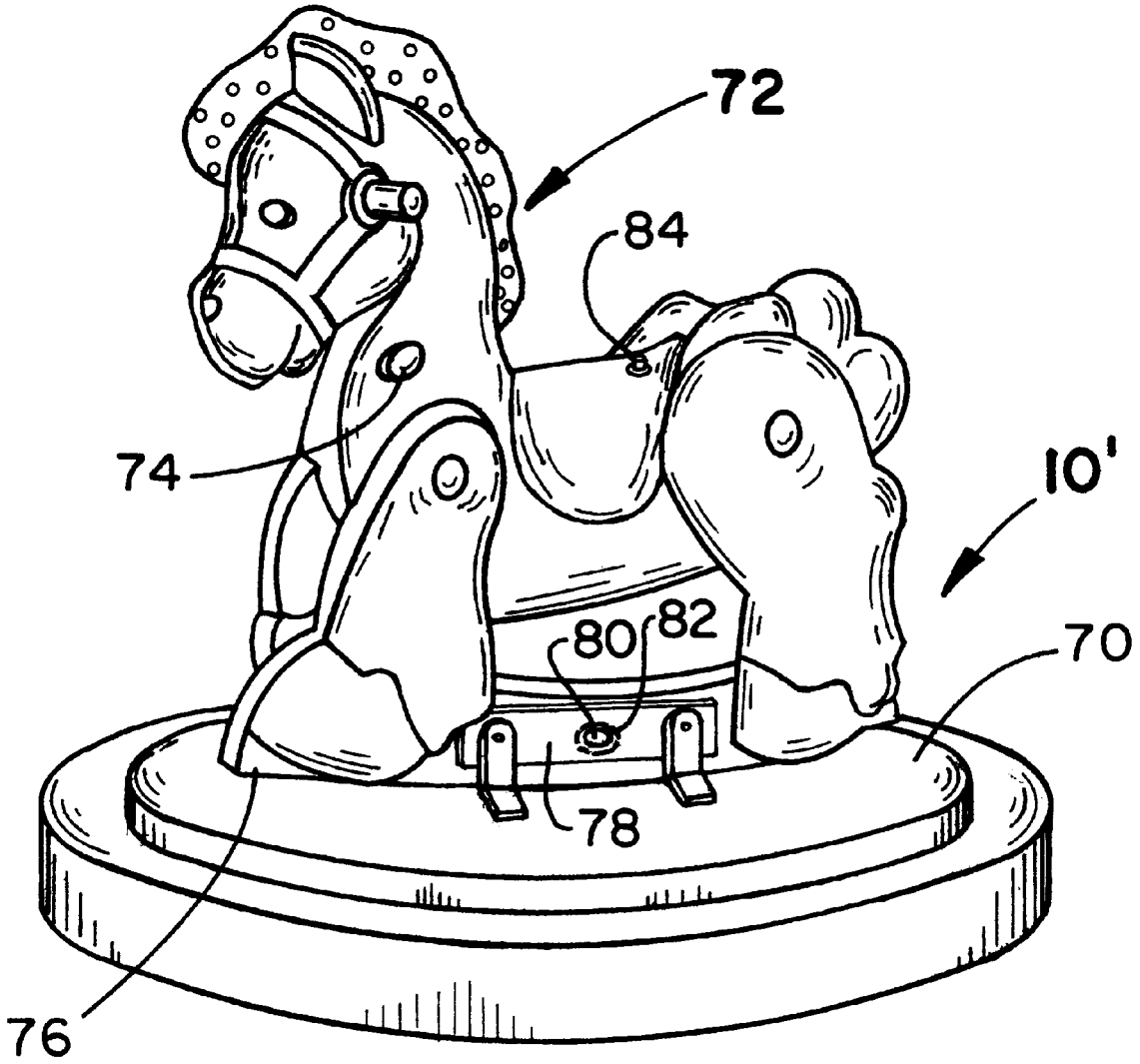
FIG. 6A is a perspective view of a first embodiment of the toddler carousel of the present invention.

As the infant outgrows carrier seats, it would be desirable if an alternative use could be found for the base 30. It is a further aspect of the present invention to enable the infant carousel to be converted to a toddler carousel which will provide entertainment for toddlers between the ages of 16 months and three years. By replacing the receptacle 12 and rotational base 42 with a second rotational base 70 having a pony 72 or similar straddleable character, the infant carousel can provide years of additional service as a toddler carousel 10'. A first preferred embodiment of the toddler carousel is shown in FIG. 6A. In this embodiment, the pony is centered (as was the infant seat assembly) over the stationary base and the pony rotates about its vertically extending axis. As an alternative to providing a separate base 70 complete with a mountable character 72, a single rotatable base for the infant carousel can be formed with mounting positions premolded to receive brackets to mount the pony.

In this embodiment, pony 72 can be provided with rocking capability. A pair of rocker skids 76 are made an integral part of the pony. Lateral fences 78 are positioned either side of rocker skids 76 and are attached to the rotating base 70.

A securement rod 80 extends through an oversized opening 82 in each skid 76 and has an end secured to each lateral fence 78 by circlips, cotter pins or the like, enabling pony 72 to be rocked by its rider while restraining pony 72 from sliding forward or back, side to side or being lifted off of the surface of base 70. As an alternative to the lateral fence 78, a center z-bracket could have a horizontal arm overlying each rocker skid 76 with a vertical rod extending downwardly through an oversized opening as before, to permit the to-and-fro rocking motion.

In replacing rotational base 42 with base 70, a higher geared motor assembly is provided enabling the carousel to be adjusted to rotate at speeds between one and eight rpm. An adjustable switch 74 can be provided for that purpose. In addition, as an energy saving and labor saving (for Mom) feature, pony 72 is preferably equipped with a cutout switch 84 on the "saddle" such that when the toddler dismounts, the carousel will automatically stop. This provides a safer dismount for the toddler and prevents the batteries from being run down when the child moves on to the next item of interest without turning off the carousel 10'.

Figure 6B:
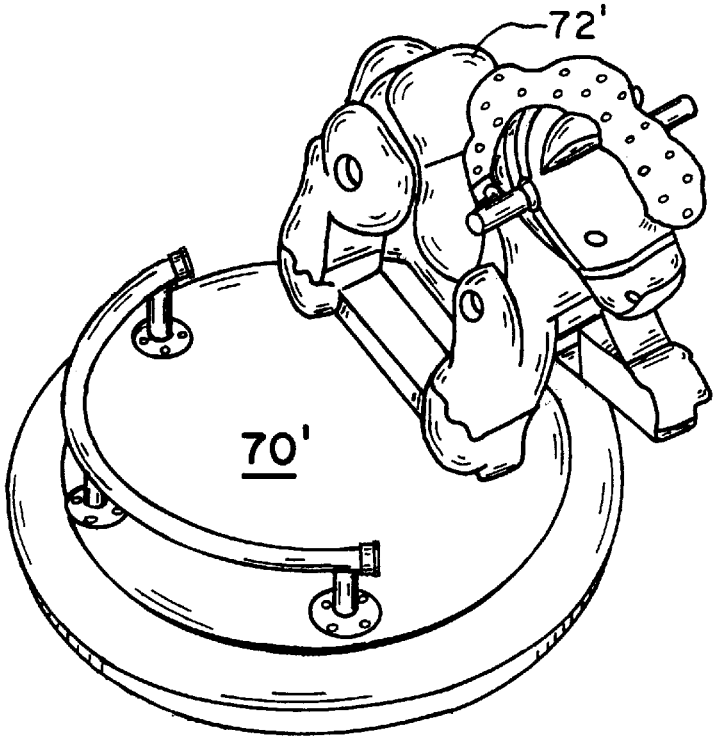
FIG. 6B is a perspective view of a second embodiment of the toddler carousel of the present invention.

In a second preferred embodiment, pony 72' is mounted near the periphery of rotational base 70' and the toddler experiences a more conventional carousel-type ride about the periphery of base 70' (FIG. 6B). While the base could be modified to permit rocking in this alternative embodiment by doubling the width of support wheels 36, as currently configured it is preferred that this embodiment not be provided with the rocking feature due to the tendency of the deflection of the base 70' causing the wheels 36 to bind so that the carousel motor 52 meets undue resistance to rotation.

Figure 7:
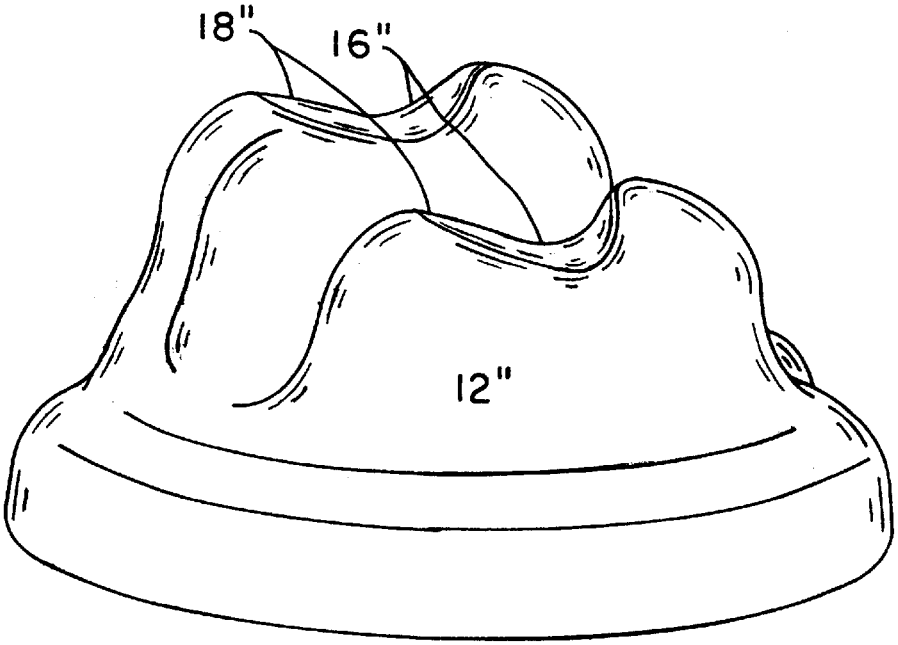
FIG. 7 is a side view of an alternate embodiment of the receptacle for the baby carrier used with the infant carousel of the present invention.

FIG. 7 depicts an alternative configuration for molded receptacle 12". In the FIG. 1A embodiment, the high sloping back on the receptacle requires an exotic, expensive mold, uses a great deal of plastic and requires up to three minute cycle times in order to permit the plastic to cool sufficiently prior to ejection from the mold. As a means to make the part less costly, it is proposed to make the receptacle simply saddle-shaped. This will significantly simplify the mold, reduce the amount of plastic required and more than halve the cycle time. Notches 16" will still receive pivot posts 22 of the baby carrier, the bottom of the carrier will sit on the flattened center portion of the receptacle 12" and sloping surfaces 18" will underlie and support the side portions of handle 24 in its locked, reclined position (FIG. 1A) stabilizing the carrier in the receptacle. Additional steps can be taken to simplify the design. For example, it will be appreciated that rotational base could be omitted, with stationary base being reconfigured to receive the motor and gear box and support bearings 36 directly engaging the underneath of molded receptacle 12.

Various changes, alternatives and modifications will become apparent following a reading of the foregoing detailed description of the present invention. It is certainly within the scope of this invention that the toddler carousel be manufactured and sold separately from the infant carousel, as opposed to simply being an alternative use as suggested herein. It is intended that all such changes, alternatives and modifications as fall within the scope of the appended claims be considered part of the present invention.

What is claimed is:

1. A toddler entertainment device comprising:

a. a stationary base having a diameter not exceeding three feet;

b. a rotational base slightly larger in diameter than said stationary base mounted thereupon by means permitting relative rotation between said rotational and stationary bases;

c. a straddleable character secured to said rotational base in a manner to rotate therewith;

d. a drive element for rotating said rotational base relative to said stationary base to entertain said toddler;

e. means for supplying power to said drive element.

2. The toddler entertainment device of claim 1 wherein said means for permitting relative rotation of said rotational base and said stationary base is a plurality of axled wheels received in apertures formed in said stationary base.

3. The toddler entertainment device of claim 1 further comprising means for securing said straddleable character to a center portion of said rotational base which permits said character to be rocked by a toddler seated thereupon.

4. The toddler entertainment device of claim 1, further comprising a safety switch built into a seat portion of said straddleable character which stops rotation of said rotational base when said toddler leaves said seat portion.

5. The toddler entertainment device of claim 1 further comprising means for securing said straddleable character to a peripheral portion of said rotational base such that a toddler mounted thereupon receives a conventional carousel-type ride.

6. A toddler entertainment device comprising:

a. a stationary base having a diameter not exceeding three feet;

b. a rotational base slightly larger in diameter than said stationary base mounted thereupon by means permitting relative rotation between said rotational and stationary bases;

c. a mountable seat secured to said rotational base in a manner to rotate therewith;

d. a drive element for rotating said rotational base relative to said stationary base to entertain said toddler;

e. means for supplying power to said drive element.

* * * * *